US006123753A

United States Patent [19]

Craig

[11] Patent Number: 6,123,753

[45] Date of Patent: Sep. 26, 2000

[54] AQUEOUS DISPERSIONS OF HYDROPHOBIZING AGENTS

[76] Inventor: Daniel H. Craig, 1516 Valencia Rd., Schenectady, N.Y. 12309

[21] Appl. No.: 09/218,235

[22] Filed: Dec. 22, 1998

Related U.S. Application Data

[63] Continuation-in-part of application No. 09/030,216, Feb. 25, 1998, abandoned.

[51] Int. Cl.[7] ..... C04B 9/02

[52] U.S. Cl. ..... 106/14.11; 106/14.27

[58] Field of Search ..... 106/14.05, 14.11, 106/14.13, 14.26, 14.27

[56] References Cited

U.S. PATENT DOCUMENTS 4,294,619 10/1981 Dulaney et al. ..... 106/177.1

5,660,890 8/1997 Rudy et al. ..... 427/388.4

*Primary Examiner*—Nathan M. Nutter

[57] ABSTRACT

Stable aqueous dispersions of organo-soluble multivalent ion salts of sulfonate group-containing compounds can be prepared in the presence of surface-active water-soluble alkyl hydroxyalkyl polysaccharides. These aqueous dispersions unexpectedly achieve high levels of storage stability at organo-soluble multivalent ion, sulfonate group-containing salt concentrations of up to 65% or greater, by weight based on total dispersion. The dispersions impart hydrophobic characteristics to the surfaces of materials onto which they are applied, are stable to storage, are compatible with a variety of other aqueous systems when blended therewith, and are useful as coatings designed for metal surfaces or as components of coatings designed for metal surfaces.

20 Claims, No Drawings

AQUEOUS DISPERSIONS OF HYDROPHOBIZING AGENTS

This application is a continuation-in-part of U.S. patent application Ser. No. 09/030,216, Feb. 25, 1998 now abandoned.

This invention relates to high solids aqueous dispersions of hydrophobizing agents, to methods of their preparation, and to aqueous blends of such dispersions. The aqueous dispersions of this invention impart hydrophobic characteristics to the surfaces of materials onto which they are applied, are stable to storage, and are compatible with a variety of other aqueous systems when blended therewith. The aqueous dispersions of this invention are also useful as coatings designed for metal surfaces or as components of coatings designed for metal surfaces.

BACKGROUND OF INVENTION

Hydrophobizing agents are widely used as water repellent materials to impart water resistance to such compositions as textiles, carpet fibers, and paper and paperboard, when applied thereon. Hydrophobizing agents can be also used to prevent corrosion of metal surfaces, when used either alone, or in combination with other materials, as components of corrosion inhibiting coatings. Many materials are known in the art to be useful as hydrophobizing agents including organometallic complexes, such as organo-soluble divalent or trivalent metal ion salts of sulfonate group-containing compounds, waxes and wax-metal emulsions, resin-based finishes, silicones, rosin, hexadecylketene dimers, and fluoro chemicals. A general review of the many types of water repellent chemicals useful as hydrophobizing agents is provided by M. Hayek in the *Encyclopedia of Chemical Technology*, Volume 24, (1984), "Waterproofing and Water/Oil Repellency" pages 442 through 465, and is incorporated herein by reference.

It is well known in the art that many hydrophobizing agents can be stabilized in aqueous dispersion form by the presence of surfactants, usually fatty acid salts, or salts of sulfated fatty alcohols, in order to facilitate their handling and application onto materials, especially at surfaces or at interfaces, for the purpose of imparting water repellency. Such dispersions typically contain relatively high concentrations of surfactant and/or protective colloids as dispersion stabilizers, typically greater than 10% by weight based on hydrophobizing agent, the presence of which surfactants or protective colloid dispersion stabilizers, while providing the necessary colloidal stability for practical preparation of such aqueous dispersions, and while providing the necessary surface activity to ensure deposition of the hydrophobizing agent at surfaces or interfaces, detracts from the repellency properties desired upon final application. This results from the presence of the hygroscopic surfactant or protective colloid dispersion stabilizer in the resulting water repellent layer, which promotes aqueous rewetting and swelling of the deposited hydrophobizing agent.

It is known that hydrophobizing agents comprising organo-soluble multivalent ion salts of sulfonate group-containing compounds, for example organo-soluble divalent or trivalent metal ion salts of sulfonate group-containing compounds, are particularly suited as corrosion inhibitors, providing corrosion protection in commercial rust preventative formulations for ballast tank coatings, temporary parts protectorants, corrosion-resistant greases, seam sealants, penetrants, adhesives, and numerous automotive and small parts coatings. For example, materials such as overbased calcium sulfonates derived from petroleum sulfonates are widely used in coatings, as they provide high resistance to chloride induced corrosion, good coating rheology, good surface wetting characteristics, water resistance or water repellency, and broad compatibility when blended with many hydrocarbon oils, petrolatums, and resins. Typically, these materials are applied as 100% solids or as solutions in organic oil carriers, which can lead to difficult handling and clean up procedures, and safety issues associated with the flammability of the solvents.

While water-borne dispersions containing overbased calcium sulfonates are known, and would be expected to overcome many of the issues just described, stabilization of the aqueous dispersion typically requires high levels of surfactants in order to achieve sufficient stability to enable the aqueous dispersion to be transported and handled prior to application. For example, U.S. Pat. No. 5,660,890 describes a water-based soft coating for metals wherein a water compatible overbased alkaline earth alkyl-aryl sulfonate is used as a rust inhibitive component. This material is provided as an emulsifiable rust-inhibitive concentrate, containing a surfactant formulated therein. It is known that high surfactant concentrations detract from the water repellency of the final coating; at least partially negating the benefit of the application of the corrosion protectorant in the first place. Thus it would be advantageous to provide aqueous dispersions of hydrophobizing agents comprising organo-soluble multivalent ion salts of sulfonate group-containing compounds, such as organo-soluble divalent or trivalent metal ion salts of sulfonate group-containing compounds, which contain low levels of surfactants or which contain no surfactant at all, in order to improve water repellency or water resistance, without sacrifice to the ability of the dispersion to impart corrosion inhibiting properties to surfaces.

Several examples of solvent-borne coatings for metal surfaces are provided. U.S. Pat. No. 4,157,991 discloses coating compositions for protecting metal surfaces having controlled proportions of an alkyl ammonium alkyl phosphate and a high molecular weight petroleum sulfonate to inhibit corrosion, silicone and silicone alkyd resins to provide a physical barrier, i.e. water repellency, trichlorotrifluoroethane and an aromatic hydrocarbon as solvents, and isopropyl alcohol as a coupling agent. An organo-soluble, water-insoluble ethyl cellulose thickener is utilized to control viscosity and vertical run-off of the coating. No mention is made of water-borne coatings or water-borne versions of such organo-soluble coatings. A similar solvent-borne strategy is disclosed in U.S. Pat. No. 4,294,619, wherein an organo-soluble, ethyl hydroxy ethyl cellulose thickener is utilized to control viscosity and vertical run-off of the coating. In this case, an organic solvent solution of ethyl hydroxy ethyl cellulose thickener and dispersed pigment is prepared, to be mixed with a partially hydrolyzed ethyl silicate resin as part of a two-component coating system. Furthermore, U.S. Pat. No. 5,338,346 relates to a soft coating for ferrous metal surface tanks, having a thickness of about 1–10 mils, comprising overbased alkaline aliphatic-aromatic organic sulfonate salt, an alkaline earth metal or zinc salt of a naphthalene sulfonate, a drying oil, a metal drier, and a paraffinic oil. The coating is particularly useful for coating ferrous metal surfaces, such as ballast tanks, which are exposed to sea water. No mention is made of water-borne coatings or water-borne versions of such organo-soluble coatings.

It is not surprising that water-borne coatings are not mentioned in the solvent-borne coatings patents described above since it is well known that the presence of water during the coating process can initiate the corrosion process itself. Nevertheless, to simplify safe handling and clean up procedures, it would be advantageous to have water-borne coatings which provide the corrosion inhibition and water repellency of the corresponding solvent-borne coatings.

Rust removing aqueous compositions or water-soluble temporary liquid spray masks are also known. Thus EP 256728 A2 880224 describes rust converting aqueous wash compositions, optionally containing water-soluble thickeners, for removing pre-existing rust, while U.S. Pat. No. 5,201,946 discloses a water-soluble liquid temporary masking composition to be spray-applied in film form to a limited area of a configured surface having a contiguous area to be coated for suppressing dust and marring in the limited area. In neither instance are advantages of corrosion prevention and water repellency combined in the form of a water-borne coating.

It is also taught in the art that water-soluble hydrophobically modified water-soluble cellulose ethers are useful in thickening and stabilizing aqueous emulsions, dispersions, and suspensions. For instance, U.S. Pat. Nos. 4,352,916 and 4,868,238 disclose that use of water-soluble hydrophobically modified nonionic cellulose ethers and carboxymethyl hydrophobically modified hydroxyethyl cellulose, respectively, provide improved particle size and less latex formation in suspension polymerization processes. In addition, U.S. Pat. Nos. 4,684,704, 4,845,175 and Eur. Pat. Appl. EP 489425 A1 920610 disclose aqueous dispersions having improved properties prepared by emulsion polymerization in the presence of water-soluble hydrophobically modified hydroxyethyl cellulose. Furthermore, U.S. Pat. No. 4,784,693 describes cementing compositions and aqueous hydraulic cementing solution comprising water-soluble, nonionic hydrophobically modified hydroxyethyl cellulose. Water-soluble polymeric surfactants derived from hydroxyethyl cellulose useful in emulsion stabilization/flocculation are described in Czechoslovakia Patent CS 214392 B 840601, Journal of Applied Polymer Science 40(3–4), 333 (1990), and Faraday Discuss. Chem Soc. 90, 323 and 365 (1991). Still further, emulsion compositions containing water-soluble alkylhydroxyalkyl cellulose derivatives for imparting artificial tan to human skin is disclosed in WO 9316683 A1 930902. Finally, several publications describe the use of water-soluble alkylhydroxyalkyl celluloses as thickeners for architectural coatings, including Eur. Pat. Appl. EP 562341 A1 930929, and Prog. Org. Coat. 22(1–4), 245 (1993). None of these disclose the use of water-soluble hydrophobically modified water-soluble cellulose ethers as stabilizers or emulsifiers for the production of aqueous dispersions of hydrophobizing agents comprising organo-soluble multivalent ion salts of sulfonate group-containing compounds such as organo-soluble divalent or trivalent metal ion salts of sulfonate group-containing compounds.

DESCRIPTION OF INVENTION

It is an object of this invention to provide aqueous dispersions of hydrophobizing agents comprising organo-soluble multivalent ion salts of sulfonate group-containing compounds, containing low levels of water-soluble emulsifiers and thickeners relative to the concentration of organic phase, to allow for increased efficacy of the organo-soluble multivalent ion salt of sulfonate group-containing compounds in end use application. It is an additional object of this invention to provide stable aqueous dispersions of said hydrophobizing agents comprising organo-soluble multivalent ion salts of sulfonate group-containing compounds for safe handling and improved clean up procedures versus the corresponding organic solvent-based compositions. Lastly, it is an object of this invention to provide aqueous dispersions of said hydrophobizing agents comprising organo-soluble multivalent ion salts of sulfonate group-containing compounds which are compatible when mixed with synthetic resin emulsions or hydrophobizing agent dispersions of different composition. These and other advantages of the present invention will be made obvious to those skilled in the art from the detailed description provided below.

It has been discovered that stable aqueous dispersions of organo-soluble multivalent ion salts of sulfonate group-containing compounds can be prepared in the presence of low concentrations of surface-active water-soluble alkyl hydroxyalkyl polysaccharides, without the required presence of other conventional emulsifiers. These aqueous dispersions unexpectedly achieve high levels of storage stability even at high concentrations of said organo-soluble multivalent ion salts of sulfonate group-containing compounds. These dispersions are stable to storage and pumping, and possess remarkable stability to thickening, separation or coagulation upon storage under ambient temperature conditions. The low concentration of surface-active water-soluble alkyl hydroxyalkyl polysaccharide required to achieve stable aqueous dispersions of organo-soluble multivalent ion salts of sulfonate group-containing compounds provides a dispersion which is also efficient in imparting both water repellency characteristics to substrates, by eliminating the rewetting of the protective hydrophobic layer which occurs when high levels of surfactants are present, and anticorrosive or rust preventative properties.

Organo-soluble multivalent ion salts of sulfonate group-containing compounds comprise organo-soluble multivalent organo-ammonium organosulfonates and divalent, trivalent, and tetravalent metal ion organosulfonates, blends of said multivalent organo-ammonium organosulfonates, divalent, trivalent, and tetravalent metal ion water-insoluble organo-sulfonates in any combination, or blends of said multivalent ion salts of sulfonate group-containing compounds with refined and unrefined waxes, petrolatums, oxidized petrolatums, oils, resins, asphaltic compounds, or synthetic resins. Preferred organo-soluble multivalent ion salts of sulfonate group-containing compounds are organo-soluble divalent and trivalent metal sulfonate salts, blends of different organo-soluble divalent and trivalent metal sulfonate salts or blends of said organo-soluble divalent and trivalent metal sulfonate salts with refined and unrefined waxes, petrolatums, oxidized petrolatums, oils, resins, asphaltic compounds, or synthetic resins. More preferred are overbased alkaline earth petroleum sulfonate or alkyl-arylsulfonate salts, blends of different overbased alkaline earth petroleum sulfonate or alkyl-arylsulfonate salts or blends of said overbased alkaline earth petroleum sulfonate or alkyl-arylsulfonate salts with refined and unrefined waxes, petrolatums, oxidized petrolatums, oils, resins, asphaltic compounds, or synthetic resins. Most preferred are overbased calcium petroleum sulfonate or alkyl-arylsulfonate salts or blends of different overbased calcium petroleum sulfonate or alkyl-arylsulfonate salts.

Aqueous dispersions of organo-soluble multivalent ion salts of sulfonate group-containing compounds typically contain from about 1%, by weight based on total aqueous dispersion, up to about 65%, by weight based on total aqueous dispersion, of organo-soluble multivalent ion salts of sulfonate group-containing compounds or blends of said organo-soluble multivalent ion salts of sulfonate group-containing compounds with refined and unrefined waxes, petrolatums, oxidized petrolatums, oils, resins, asphaltic compounds, or synthetic resins. Preferably, aqueous dispersions of organo-soluble multivalent ion salts of sulfonate group-containing compounds contain from about 5%, by weight based on total aqueous dispersion, up to about 60%, by weight based on total aqueous dispersion, of organo-soluble multivalent ion salts of sulfonate group-containing compounds or blends of said organo-soluble multivalent ion salts of sulfonate group-containing compounds with refined and unrefined waxes, petrolatums, oxidized petrolatums, oils, resins, asphaltic compounds, or synthetic resins. More preferably, aqueous dispersions of organo-soluble multivalent ion salts of sulfonate group-containing compounds contain from about 15%, by weight based on total aqueous dispersion, up to about 55%, by weight based on total aqueous dispersion, of organo-soluble multivalent ion salts of sulfonate group-containing compounds or blends of said organo-soluble multivalent ion salts of sulfonate group-containing compounds with refined and unrefined waxes, petrolatums, oxidized petrolatums, oils, resins, asphaltic compounds, or synthetic resins. Most preferably, aqueous dispersions of said organo-soluble multivalent ion salts of sulfonate group-containing compounds contain from about 25% by weight, based on total aqueous dispersion, up to about 50% by weight, based on total aqueous dispersion, of organo-soluble multivalent ion salts of sulfonate group-containing compounds or blends of said organo-soluble multivalent ion salts of sulfonate group-containing compounds with refined and unrefined waxes, petrolatums, oxidized petrolatums, oils, resins, asphaltic compounds, or synthetic resins.

For aqueous dispersions containing blends of organo-soluble multivalent ion salts of sulfonate group-containing compounds with refined and unrefined waxes, petrolatums, oxidized petrolatums, oils, resins, asphaltic compounds, or synthetic resins, preferred are blend ratios, by weight of total blend, of 1:99 to 99:1 of said organo-soluble multivalent ion salts of sulfonate group-containing compounds to any combination of refined and unrefined waxes, petrolatums, oxidized petrolatums, oils, resins, asphaltic compounds, or synthetic resins. Most preferred are blend ratios, by weight of total blend, of 25:75 to 75:25 of said organo-soluble multivalent ion salts of sulfonate group-containing compounds to any combination of refined and unrefined waxes, petrolatums, oxidized petrolatums, oils, resins, asphaltic compounds, or synthetic resins. Blends of organo-soluble multivalent ion salts of sulfonate group-containing compounds with refined and unrefined waxes, petrolatums, oxidized petrolatums, oils, resins, asphaltic compounds, or synthetic resins are utilized to reduce the manufacturing cost of the aqueous dispersion or to refine the application properties of the aqueous dispersion for a given end use.

Surface-active water-soluble alkyl hydroxyalkyl polysaccharides contemplated by the present invention comprise semi-synthetic hydroxyethyl, hydroxypropyl, or hydroxybutyl polysaccharides containing alkyl groups with greater than five carbon atoms up to about thirty carbon atoms. Preferred are hydroxyethyl or hydroxypropyl polysaccharides containing alkyl groups with greater than six carbon atoms up to about twenty-four carbon atoms. More preferred are hydroxyethyl polyglucans containing alkyl groups with greater than seven carbon atoms up to about twenty-two carbons atoms. While alkyl groups on the polysaccharide are required for optimized function of the instant invention, substitution of alkyl groups cannot be so great that water-solubility is prevented at use temperatures of the resulting dispersion. Thus most preferred are hydroxyethyl celluloses containing alkyl groups with greater than seven carbon atoms up to about twenty-two carbon atoms, whose water solubility is at least 0.1% by weight, in water, in the temperature range from about 10° C. up to 100° C. Water-soluble alkyl hydroxyalkyl polysaccharides can be further modified through the introduction of other groups, such carboxymethyl groups or cationic groups, which provide increased water solubility at higher alkyl group concentrations, without departing from the scope of this invention. In some cases, both the alkyl group and either the anionic or the cationic group are introduced simultaneously, as exemplified by the alkyl modified hydroxyethyl cellulose quaternary salt, polyquaternium-24. These compounds are also included within the scope of the instant invention.

The dispersions of the instant invention contain from about 0.025%, by weight based on total dispersion, up to about 5%, by weight based on total dispersion, of water-soluble alkyl hydroxyalkyl polysaccharide, more preferably from about 0.05%, by weight based on total dispersion, up to about 4.0%, by weight based on total dispersion, of water-soluble alkyl hydroxyalkyl polysaccharide, most preferably from about 0.1%, by weight based on total dispersion, up to about 3.0%, by weight based on total dispersion of water-soluble alkyl hydroxyalkyl polysaccharide.

It is well known in the art to utilize combinations of dispersion stabilizers in order to fine tune the characteristics of the resulting aqueous dispersion for viscosity and ease of application. Thus, the present invention contemplates the use of combinations of surface-active water-soluble alkyl hydroxyalkyl polysaccharides together with, as optional secondary dispersion stabilizers, traditional surfactants known in the art, including anionic, cationic, nonionic, and amphoteric surfactants. The presence of these optional secondary dispersion stabilizers, while not required, can allow fine-tuning of the characteristics of the coating compositions to optimize the application of the coating to the substrate.

It is also known in the art to use water-soluble thickeners or rheology modifiers in order to modify the Theological characteristics of the dispersion, as well as to minimize the concentration of required primary stabilizer necessary to achieve the required dispersion stability. While not required, water-soluble thickeners useful as optional secondary dispersion stabilizers are materials known in the art to provide effective thickening. Particularly useful thickeners are semi-synthetic water-soluble polymers, i.e., water-soluble polymers derived in part from natural sources which have been post-modified chemically to achieve a certain improvement in properties, or natural gums. An example of a semi-synthetic water-soluble polymer is the well known carboxymethyl cellulose, wherein natural water-insoluble cellulose has been modified with carboxymethyl groups, through reaction of cellulose with monochloroacetic acid under alkaline conditions, to render it water-soluble.

The following examples serve to illustrate specific aspects of the instant invention without intending to restrict the scope and spirit of what is claimed. All portions described below are by weight.

EXAMPLE 1

2.0 parts hexadecyl 2-hydroxyethyl ether of cellulose (1% aqueous solution viscosity 350 cps at room temperature), predissolved in 290 parts distilled water, and 300 parts thixotropic overbased calcium petroleum sulfonate concentrate (25° C. viscosity 110,000 cps) were mixed and agitated at room temperature, subsequently homogenized via ultrasonic treatment at 375 watts for 150 seconds utilizing a Cole-Parmer High Intensity Ultrasonic Processor, and cooled rapidly to room temperature with constant agitation. The mixture yielded a homogeneous, fluid aqueous dispersion containing 50.7% by weight of total dispersion of thixotropic overbased calcium petroleum sulfonate concentrate, pH=12.2, viscosity=1,000 cps, and was stable to storage at room temperature for more than 12 months. This example illustrates the use of an alkyl hydroxyalkyl cellulose as the sole emulsifier according to the instant invention.

EXAMPLE 2

3.0 parts hexadecyl 2-hydroxyethyl ether of cellulose (1% aqueous solution viscosity 350 cps at room temperature), predissolved in 290 parts distilled water, and 300 parts thixotropic overbased calcium petroleum sulfonate concentrate (25° C. viscosity 110,000 cps) were mixed and agitated at room temperature, subsequently homogenized via ultrasonic treatment at 375 watts for 150 seconds utilizing a Cole-Parmer High Intensity Ultrasonic Processor, and cooled rapidly to room temperature with constant agitation. The mixture yielded a homogeneous, fluid aqueous dispersion containing 50.6% by weight of total dispersion of thixotropic overbased calcium petroleum sulfonate concentrate, pH=12.2, viscosity=9,000 cps, and was stable to storage at room temperature for more than 12 months. This example illustrates the use of an alkyl hydroxyalkyl cellulose as the sole emulsifier producing a dispersion of high viscosity according to the instant invention.

EXAMPLE 3

2.0 parts hexadecyl 2-hydroxyethyl ether of cellulose (1% aqueous solution viscosity 350 cps at room temperature), 1.0 part methylcellulose (2% aqueous solution viscosity 15 cps), both predissolved in the same 290 parts distilled water, and 300 parts thixotropic overbased calcium petroleum sulfonate concentrate (25° C. viscosity 110,000 cps) were mixed and agitated at room temperature, subsequently homogenized via ultrasonic treatment at 375 watts for 150 seconds utilizing a Cole-Parmer High Intensity Ultrasonic Processor, and cooled rapidly to room temperature with constant agitation. The mixture yielded a homogeneous, fluid aqueous dispersion containing 50.6% by weight of total dispersion of thixotropic overbased calcium petroleum sulfonate concentrate, pH of 12.2, viscosity=1,200 cps, and was stable to storage at room temperature for more than 12 months. This example illustrates the use of an alkyl hydroxyalkyl cellulose together with an optional semi-synthetic water-soluble polymer according to the instant invention.

EXAMPLE 4

2.5 parts hexadecyl 2-hydroxyethyl ether of cellulose (1% aqueous solution viscosity 350 cps at room temperature), 2.0 part sodium dioctylsulfosuccinate (75% in aqueous ethanol), both predissolved in the same 290 parts distilled water, and 300 parts thixotropic overbased calcium petroleum sulfonate concentrate (25° C. viscosity 110,000 cps) were mixed and agitated at room temperature, subsequently homogenized via ultrasonic treatment at 375 watts for 150 seconds utilizing a Cole-Parmer High Intensity Ultrasonic Processor, and cooled rapidly to room temperature with constant agitation. The mixture yielded a homogeneous, fluid aqueous dispersion containing 50.5% by weight of total dispersion of thixotropic overbased calcium petroleum sulfonate concentrate, pH=12.2, viscosity=900 cps, and was stable to storage at room temperature for more than 12 months. This example illustrates the use of an alkyl hydroxyalkyl cellulose together with an optional anionic surfactant according to the instant invention.

EXAMPLE 5

2.5 parts hexadecyl 2-hydroxyethyl ether of cellulose (1% aqueous solution viscosity 350 cps at room temperature), 1.0 part N-cetyl, N-ethyl morpholinium ethosulfate (35% in water), both predissolved in the same 290 parts distilled water, and 300 parts thixotropic overbased calcium petroleum sulfonate concentrate (25° C. viscosity 110,000 cps) were mixed and agitated at room temperature, subsequently homogenized via ultrasonic treatment at 375 watts for 150 seconds utilizing a Cole-Parmer High Intensity Ultrasonic Processor, and cooled rapidly to room temperature with constant agitation. The mixture yielded a homogeneous, fluid aqueous dispersion containing 50.5% by weight of total dispersion of thixotropic overbased calcium petroleum sulfonate concentrate, pH=12.2, viscosity=1,300 cps, and was stable to storage at room temperature for more than 12 months. This example illustrates the use of an alkyl hydroxyalkyl cellulose together with an optional cationic surfactant according to the instant invention.

EXAMPLE 6

3.0 parts alkyl modified hydroxyethyl cellulose quaternary salt (polyquaternium-24), predissolved in 290 parts distilled water, and 314 parts thixotropic overbased calcium petroleum sulfonate concentrate (25° C. viscosity 110,000 cps) were mixed and agitated at room temperature, subsequently homogenized via ultrasonic treatment at 375 watts for 150 seconds utilizing a Cole-Parmer High Intensity Ultrasonic Processor, and cooled rapidly to room temperature with constant agitation. The mixture yielded a homogeneous, fluid aqueous dispersion containing 51.7% by weight of total dispersion of thixotropic overbased calcium petroleum sulfonate concentrate, pH of 12.2, viscosity=350 cps, and was stable to storage at room temperature for more than 12 months. This example illustrates the use of a cationic-modified alkyl hydroxyalkyl cellulose according to the instant invention.

EXAMPLE 7

2.0 parts hexadecyl 2-hydroxyethyl ether of cellulose (1% aqueous solution viscosity 350 cps at room temperature), predissolved in 290 parts distilled water, 150 parts thixotropic overbased calcium petroleum sulfonate concentrate (25° C. viscosity 110,000 cps), and 150 parts white petroleum jelly, i.e.,petrolatum, were mixed and agitated at room temperature, subsequently homogenized via ultrasonic treatment at 375 watts for 150 seconds utilizing a Cole-Parmer High Intensity Ultrasonic Processor, and cooled rapidly to room temperature with constant agitation. The mixture yielded a homogeneous, fluid aqueous dispersion containing 50.7% by weight of total dispersion of a 50/50 blend of thixotropic overbased calcium petroleum sulfonate concentrate with white petroleum jelly, pH=11.8, viscosity=1000 cps, and was stable to storage at room temperature for more than 12 months. This example illustrates the use of a blend of an organo-soluble multivalent ion salt of a sulfonate group-containing compound with petrolatum according to the instant invention.

EXAMPLE 8

3 parts of the composition described in EXAMPLE 1 were mixed with 100 parts of a 50% aqueous dispersion of butyl acrylate/methyl methacrylate copolymer with slow stirring. The blend was stable to storage and could be readily coated onto various substrates. This example illustrates a stable aqueous blend of an aqueous synthetic resin emulsion and a dispersion of an organo-soluble multivalent ion salt of a sulfonate group-containing compound according to the instant invention.

The aqueous dispersions of this invention impart hydrophobic characteristics to the surfaces of materials onto which they are applied, are stable to storage, are compatible with a variety of other aqueous systems when blended therewith, and are useful as coatings designed for metal surfaces or as components of coatings designed for metal surfaces.

It will be obvious to those skilled in the art that many modifications can be made to the instant invention, descriptions of which were not specifically included in the preceding written disclosure without departing from the spirit and scope of what is claimed below:

I claim:

1. A composition of matter which is an aqueous dispersion comprising:

a) from about 0.025% up to about 5% of a water-soluble alkyl hydroxyalkyl polysaccharide, by weight based on total weight of aqueous dispersion, wherein the water-soluble alkyl hydroxyalkyl polysaccharide is selected from the group comprising water-soluble hydroxyethyl alkyl polysaccharides, water-soluble hydroxypropyl alkyl polysaccharides, water-soluble hydroxybutyl alkyl polysaccharides, and water-soluble hydroxyethyl hydroxypropyl alkyl polysaccharides, wherein the alkyl group contains greater than five carbon atoms up to thirty carbon atoms, b) optionally secondary dispersion stabilizers, and c) from about 1% up to about 65% of a hydrophobizing agent, by weight based on total weight of aqueous dispersion, wherein the hydrophobizing agent is selected from the group comprising multivalent ion salts of sulfonate group-containing organic compounds selected from the group comprising alkylsulfonates, alkenylsulfonates, arylsulfonates, alkyl-arylsulfonates, and alkenyl-arylsulfonates.

2. The composition of claim 1 wherein the multivalent ion salts of sulfonate group-containing compounds are selected from the group comprising divalent, trivalent, and tetravalent metal ion salts of sulfonate group-containing organic compounds selected from the group comprising alkylsulfonates, alkenylsulfonates, arylsulfonates, alkyl-arylsulfonates, and alkenyl-arylsulfonates.

3. The composition of claim 1 wherein the multivalent ion salts of sulfonate group-containing compounds are selected from the group comprising divalent and trivalent metal ion salts of sulfonate group-containing organic compounds selected from the group comprising alkylsulfonates, alkenylsulfonates, arylsulfonates, alkyl-arylsulfonates, and alkenyl-arylsulfonates.

4. The composition of claim 1 wherein the multivalent ion salts of sulfonate group-containing compounds are selected from the group comprising divalent metal ion salts of sulfonate group-containing organic compounds selected from the group comprising alkylsulfonates, alkenylsulfonates, arylsulfonates, alkyl-arylsulfonates, and alkenyl-arylsulfonates.

5. The composition of claim 1 wherein the multivalent ion salts of sulfonate group-containing compounds are selected from the group comprising alkaline earth metal ion salts of sulfonate group-containing organic compounds selected from the group comprising alkylsulfonates, alkenylsulfonates, arylsulfonates, alkyl-arylsulfonates, and alkenyl-arylsulfonates.

6. The composition of claim 1 wherein the sulfonate group-containing organic compounds are selected from the group comprising alkylsulfonates, arylsulfonates, and alkyl-arylsulfonates.

7. The composition of claim 2 wherein the sulfonate group-containing organic compounds are selected from the group comprising alkylsulfonates, arylsulfonates, and alkyl-arylsulfonates.

8. The composition of claim 3 wherein the sulfonate group-containing organic compounds are selected from the group comprising alkylsulfonates, arylsulfonates, and alkyl-arylsulfonates.

9. The composition of claim 4 wherein the sulfonate group-containing organic compounds are selected from the group comprising alkylsulfonates, arylsulfonates, and alkyl-arylsulfonates.

10. The composition of claim 5 wherein the sulfonate group-containing organic compounds are selected from the group comprising alkylsulfonates, arylsulfonates, and alkyl-arylsulfonates.

11. The composition of claim 1 wherein the water-soluble alkyl hydroxyalkyl polysaccharide is selected from the group comprising water-soluble hydroxyethyl alkyl cellulose, water-soluble hydroxypropyl alkyl cellulose, water-soluble hydroxybutyl alkyl cellulose, and water-soluble hydroxyethyl hydroxypropyl alkyl cellulose wherein the alkyl group contains greater than five carbon atoms up to thirty carbon atoms.

12. The composition of claim 2 wherein the water-soluble alkyl hydroxyalkyl polysaccharide is selected from the group comprising water-soluble hydroxyethyl alkyl cellulose, water-soluble hydroxypropyl alkyl cellulose, water-soluble hydroxybutyl alkyl cellulose, and water-soluble hydroxyethyl hydroxypropyl alkyl cellulose wherein the alkyl group contains greater than five carbon atoms up to thirty carbon atoms.

13. The composition of claim 3 wherein the water-soluble alkyl hydroxyalkyl polysaccharide is selected from the group comprising water-soluble hydroxyethyl alkyl cellulose, water-soluble hydroxypropyl alkyl cellulose, water-soluble hydroxybutyl alkyl cellulose, and water-soluble hydroxyethyl hydroxypropyl alkyl cellulose wherein the alkyl group contains greater than five carbon atoms up to thirty carbon atoms.

14. The composition of claim 4 wherein the water-soluble alkyl hydroxyalkyl polysaccharide is selected from the group comprising water-soluble hydroxyethyl alkyl cellulose, water-soluble hydroxypropyl alkyl cellulose, water-soluble hydroxybutyl alkyl cellulose, and water-soluble hydroxyethyl hydroxypropyl alkyl cellulose wherein the alkyl group contains greater than five carbon atoms up to thirty carbon atoms.

15. The composition of claim 6 wherein the water-soluble alkyl hydroxyalkyl polysaccharide is selected from the group comprising water-soluble hydroxyethyl alkyl cellulose, water-soluble hydroxypropyl alkyl cellulose, water-soluble hydroxybutyl alkyl cellulose, and water-soluble hydroxyethyl hydroxypropyl alkyl cellulose wherein the alkyl group contains greater than five carbon atoms up to thirty carbon atoms.

16. The composition of claim 7 wherein the water-soluble alkyl hydroxyalkyl polysaccharide is selected from the group comprising water-soluble hydroxyethyl alkyl cellulose, water-soluble hydroxypropyl alkyl cellulose, water-soluble hydroxybutyl alkyl cellulose, and water-soluble hydroxyethyl hydroxypropyl alkyl cellulose wherein the alkyl group contains greater than five carbon atoms up to thirty carbon atoms.

17. The composition of claim 8 wherein the water-soluble alkyl hydroxyalkyl polysaccharide is selected from the group comprising water-soluble hydroxyethyl alkyl cellulose, water-soluble hydroxypropyl alkyl cellulose, water-soluble hydroxybutyl alkyl cellulose, and water-soluble hydroxyethyl hydroxypropyl alkyl cellulose wherein the alkyl group contains greater than five carbon atoms up to thirty carbon atoms.

18. The composition of claim 7 wherein the water-soluble alkyl hydroxyalkyl polysaccharide is selected from the group comprising water-soluble hydroxyethyl alkyl cellulose, water-soluble hydroxypropyl alkyl cellulose, water-soluble hydroxybutyl alkyl cellulose, and water-soluble hydroxyethyl hydroxypropyl alkyl cellulose wherein the alkyl group contains greater than five carbon atoms up to thirty carbon atoms.

19. A method for producing a composition of matter which is an aqueous dispersion comprising:

a) from about 0.025% up to about 5% of a water-soluble alkyl hydroxyalkyl polysaccharide, by weight based on total weight of aqueous dispersion, wherein the water-soluble alkyl hydroxyalkyl polysaccharide is selected from the group comprising water-soluble hydroxyethyl alkyl polysaccharides, water-soluble hydroxypropyl alkyl polysaccharides, water-soluble hydroxybutyl alkyl polysaccharides, and water-soluble hydroxyethyl hydroxypropyl alkyl polysaccharides, wherein the alkyl group contains greater than five carbon atoms up to thirty carbon atoms, b) optionally secondary dispersion stabilizers, and c) from about 1% up to about 65% of a hydrophobizing agent, by weight based on total weight of aqueous dispersion, wherein the hydrophobizing agent is selected from the group comprising multivalent ion salts of sulfonate group-containing organic compounds selected from the group comprising alkylsulfonates, alkenylsulfonates, arylsulfonates, alkyl-arylsulfonates, and alkenyl-arylsulfonates, comprising dispersing multivalent ion salts of sulfonate group-containing compounds selected from the group comprising alkylsulfonates, alkenylsulfonates, arylsulfonates, alkyl-arylsulfonates, and alkenyl-arylsulfonates into water in the presence of a water-soluble alkyl hydroxyalkyl polysaccharide selected from the group comprising water-soluble hydroxyethyl alkyl polysaccharides, water-soluble hydroxypropyl alkyl polysaccharides, water-soluble hydroxybutyl alkyl polysaccharides, and water-soluble hydroxyethyl hydroxypropyl alkyl polysaccharides to form the aqueous dispersion.

20. An aqueous blend of the composition of claim 1 and an aqueous synthetic resin emulsion.

* * * * *